United States Patent [19]

Glaus

[11] 4,223,704

[45] Sep. 23, 1980

[54] METHOD AND APPARATUS FOR ATTACHING A METALLIC CONNECTION ELEMENT AT A SUPPORT, ESPECIALLY FOR CONNECTING THE OVER-LAPPING SECTIONS OF A PACKAGING BAND OR THE LIKE

[75] Inventor: Heinrich Glaus, Niederwangen, Switzerland

[73] Assignee: Strapex AG, Wohlen, Switzerland

[21] Appl. No.: 966,820

[22] Filed: Dec. 6, 1978

[30] Foreign Application Priority Data

Dec. 28, 1977 [CH] Switzerland ..... 16118/77

[51] Int. Cl.[3] ..... B21F 9/02

[52] U.S. Cl. ..... 140/93.4; 100/33 R

[58] Field of Search ..... 140/93 R, 93.4, 93.2; 100/30, 33 R; 113/54, 55, 58; 29/513, 243.56

[56] References Cited

U.S. PATENT DOCUMENTS

| | | | |
|---|---|---|---|
| 1,885,742 | 11/1932 | MacChesney et al. | 140/93.4 |
| 3,695,307 | 10/1972 | Kuoni | 140/93.4 |
| 4,056,128 | 11/1977 | Konrad | 140/93.4 |

*Primary Examiner*—Lowell A. Larson

*Attorney, Agent, or Firm*—Werner W. Kleeman

[57] ABSTRACT

A method of, and apparatus for, interconnecting the overlapping band sections of a packaging or strapping band wrapped around an article, by means of a closure seal having closure flaps extending in the lengthwise direction of the seal and located at oppositely situated sides of a floor or base portion of the seal. The closure flaps protrude from the seal. These closure flaps of the closure seal which bears at its base portion upon a counter holder, are placed over one another and pressed against the base portion by means of a rolling or roller element which is moved in the lengthwise direction of the closure seal from one end thereof and over such closure seal. The band sections bearing upon the base portion are fixedly clamped between the closed closure flaps and the base portion. The rolling or roller element is seated upon a rotatable shaft moved translatory in lengthwise direction of the closure seal by means of a rack-and-pinion drive. The rolling element is rotated by means of a toothed segment which is rigidly connected for rotation with the rolling element and, during the lengthwise displacement of the rotatable shaft, rolls upon a stationary gear rack.

18 Claims, 6 Drawing Figures

Fig. 1
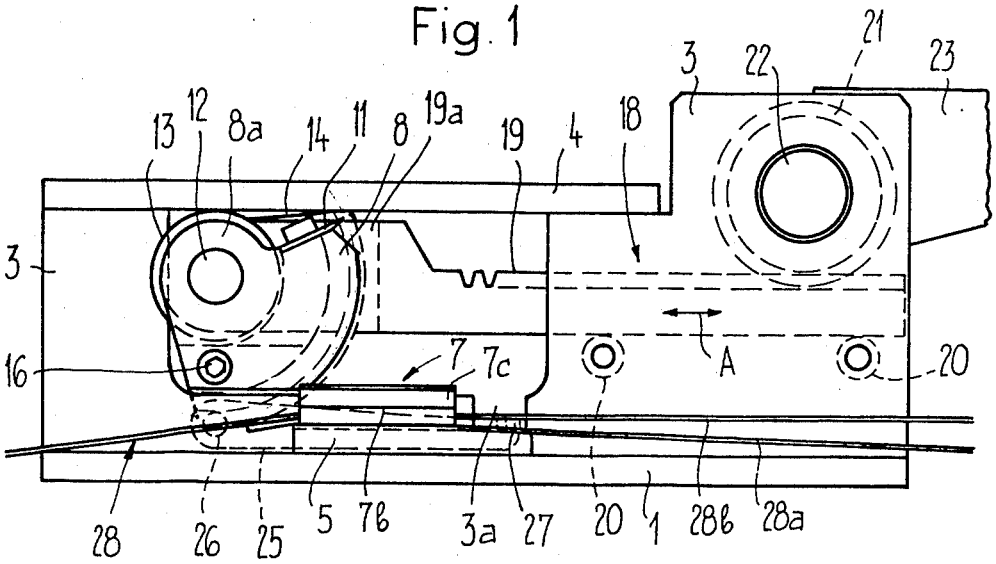
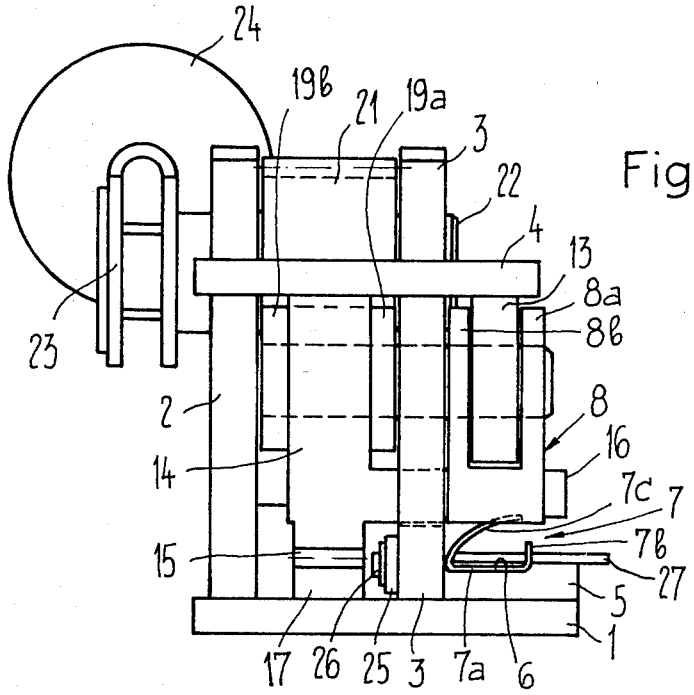
Fig. 2

Fig. 5
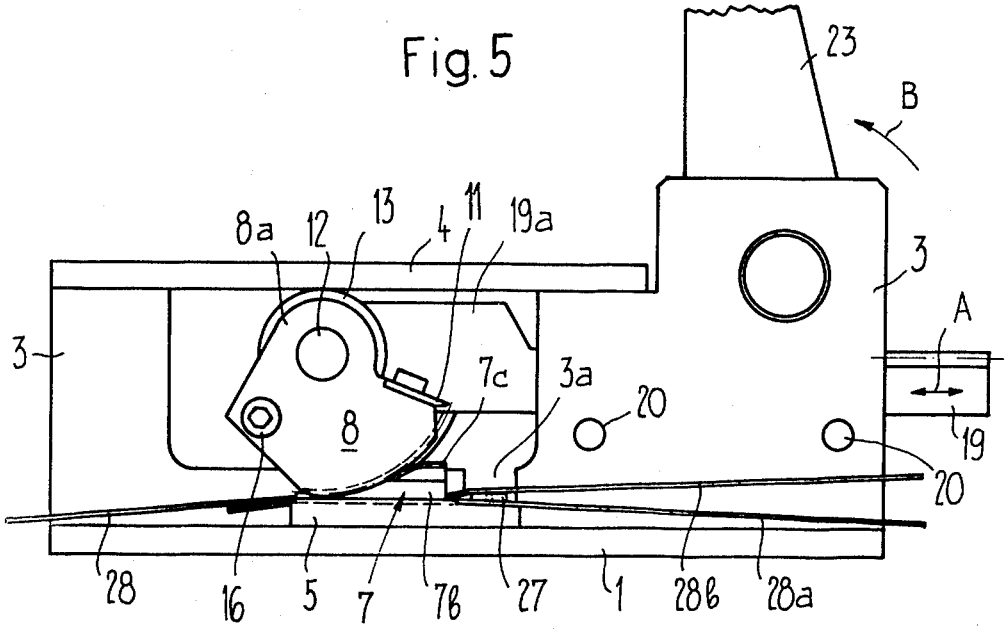
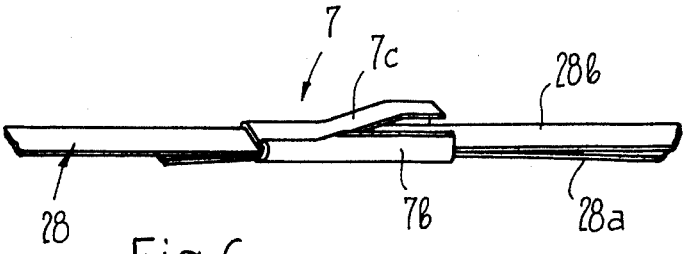
Fig. 6

METHOD AND APPARATUS FOR ATTACHING A METALLIC CONNECTION ELEMENT AT A SUPPORT, ESPECIALLY FOR CONNECTING THE OVER-LAPPING SECTIONS OF A PACKAGING BAND OR THE LIKE

BACKGROUND OF THE INVENTION

The present invention relates to a new and improved method of attaching a metallic connection element, which is of the type having closure flaps or tabs extending in the lengthwise direction of the connection element, arranged at opposite sides of a base portion thereof and protruding therefrom, with at least one carrier or support bearing at the base portion. During the connection operation the closure flaps are located over one another and pressed against the base portion, so that the carrier is fixedly clamped between the base portion and the closure flaps. The invention also pertains to novel apparatus for the performance of such method. The method and apparatus of the invention are particularly used for interconnecting overlapping sections of a band or strap or the like, which is wrapped around an article, by means of the connection or closure element.

With the strapping device taught to the art from Swiss Pat. No. 583,089, the closure flaps of the metallic closure seal which bear by means of their base portion upon a counter holder or counter support, are placed in overlying relationship and pressed aginst the base portion by means of a punch which is displaceable towards the counter support. Both closure flaps are simultaneously bent over towards the base portion throughout their entire length. The closure flaps have the tendency, after they have been bent over, to spring back into their original position which they had prior to the bending operation. Consequently, the holding force exerted upon the band ends of the packaging band, and which ends are to be interconnected, tends to let up somewhat. As a result, there is reduced the loadability of the connection in the presence of tensile loads.

SUMMARY OF THE INVENTION

Therefore, with the foregoing in mind it is a primary object of the present invention to overcome these drawbacks.

Another and more specific object of the present invention aims at the provision of a new and improved method and apparatus of the previously mentioned type, enabling attachment of at least one connection element to at least one carrier without the overlying closure flaps which have been pressed against the base portion tending to again upright themselves.

Still a further significant object of the present invention at the provision of a new and improved method, and apparatus for, connecting the overlapping portions or sections of a packaging band or the like, in a positive and reliable manner without any tendency of the pressed down overlapping connection tabs moving back towards their original position prior to bending down thereof.

Now in order to implement these and still further objects of the invention, which will become more readily apparent as the description proceeds, the method aspects of the present development are manifested by the features that at least one closure flap or tab of the connection element is progressively pressed against the base portion thereof in the lengthwise direction of such connection element.

The apparatus for the performance of the aforementioned method is manifested by the features that there is provided a closure device which presses at least one closure flap of the connection element in its lengthwise direction progressively against the base portion of such closure element.

During pressing of the closure flap towards the base portion, progressively in the lengthwise direction of the connection element, individual sections or portions of the closure flap are continuously or stepwise strongly pressed against the base portion. During pressing down of a section the previously pressed down section does tend to again raise somewhat from the base portion, but such section thereafter again springs back into its previous position where it fixedly presses the carrier once again against the base portion. The side flap which has been pressed in this manner against the base portion thus has the tendency of pressing against the base portion.

Advantageously both of the closure flaps are progressively placed over one another and pressed against the base portion in the lengthwise direction of the connection element.

With a preferred embodiment of the invention the closure flap or closure flaps are rolled against the base portion. To this end, there is preferably provided at least one rolling or roller element having a direction of rolling which coincides with the lengthwise direction of the connection element. This rolling element has at least one rolling surface which is curved in the direction of rolling and is intended to progressively act upon at least one of the closure flaps. This rolling element is advantageously rotatable about a shaft or axle which can be translationally displaced in the lengthwise direction of the connection element.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a side view of an apparatus for connecting the overlapping portions of a packaging or strapping band or the like;

FIG. 2 is an enlarged rear view of the apparatus of FIG. 1;

FIG. 5 is an illustration of the apparatus, analogous to the showing of FIG. 1, during the closing of a connection element or seal; and FIG. 6 is a perspective view of a partially closed closure or connection seal.

DETAILED DESCRIPTION OF THE PREFERRED EMBODIMENTS

Figure 3:
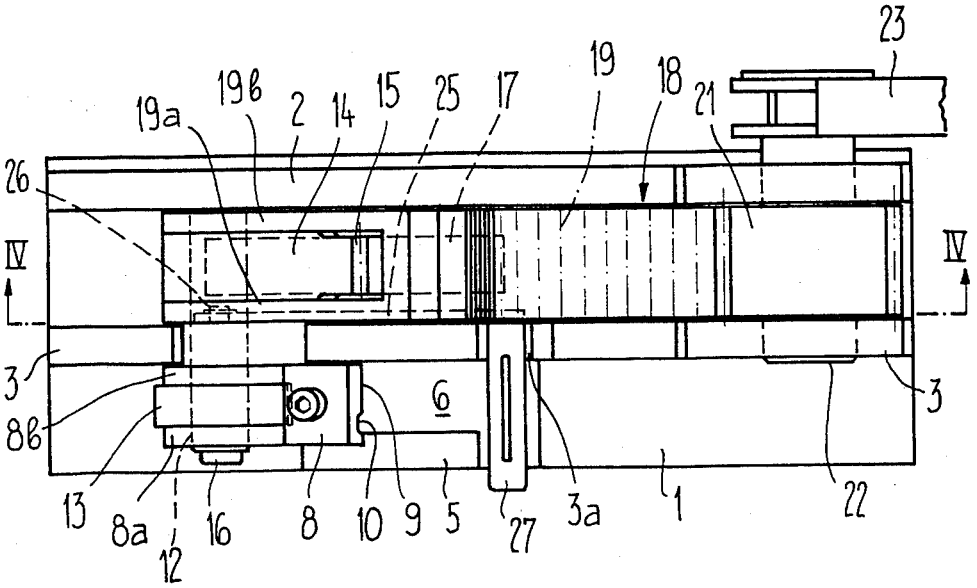
FIG. 3 is a top plan view of the apparatus of FIG. 1 with the cover plate removed.
Figure 4:
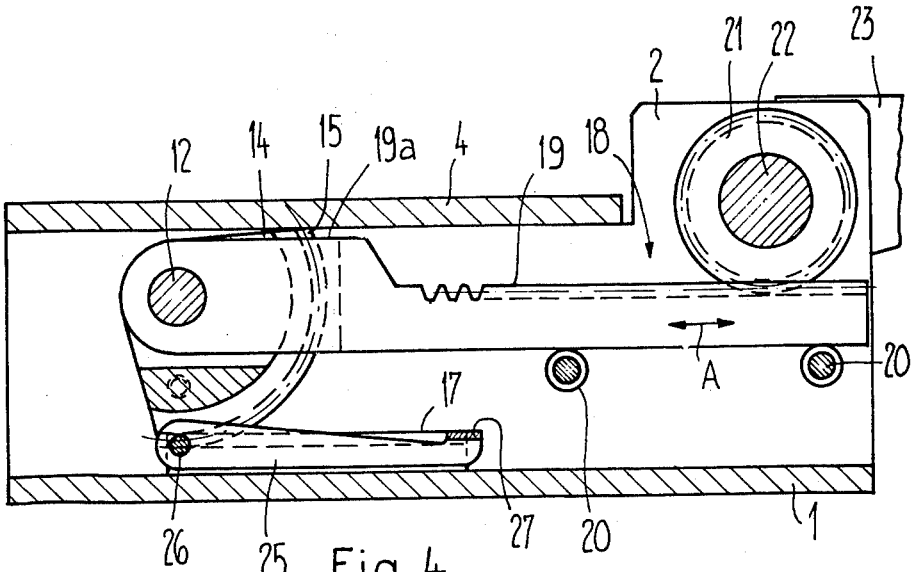
FIG. 4 is a sectional view, taken substantially along the line IV—IV of FIG. 3.

Describing now the drawings, the strapping or packaging apparatus shown in the various Figures will be seen to comprise a base plate 1 from which upwardly protrudes a side wall 2 and an intermediate or central wall 3 having an opening 3*a*. The side wall 2 and the intermediate wall 3 extend substantially parallel to one another and at right angles to the base plate 1. At its upper region the strapping apparatus is covered by a cover plate 4 which extends essentially parallel to the base plate 1. This cover plate 4 bears upon the side wall 2 and the intermediate wall 3. Mounted upon the base plate 1 is a counter holder or counter support 5 having a recess 6 in which there can be inserted the closure or connection element, typically a connection or closure seal 7, which is to be closed. Such connection or closure seal 7 will be seen to comprise a base portion 7*a* which bears upon the counter support 5, a narrow closure tab or flap 7*b* and a wide closure tab or flap 7*c*. Both of the closure flaps 7*b* and 7*c* extend in the lengthwise direction of the closure seal 7 and are arranged at opposite sides of the base portion 7*a*. The narrow closure flap 7*b* protrudes approximately at right angles from and with respect to the base portion 7*a*, whereas the wide closure flap 7*c* is domed or arched and has its end section disposed higher than the upper edge of the narrow closure flap 7*b*.

Now in order to close the closure flaps 7*b*, 7*c* of the closure or connection seal 7 there is provided a rolling or roller element 8 having the form of a roll segment. As best seen by referring to FIG. 3, the rolling element 8 has a first rolling surface 9 and a second surface 10. The first rolling surface 9 is formed by part of the outer surface of a circular cylinder, whereas the second rolling surface 10, merging with the first rolling surface 9, is formed by the boundary surface of a groove-like depression or recess. The second rolling surface 10 is curved, like the first rolling surface 9, in the rolling direction. Additionally, this second rolling surface 10 also is curved in a direction extending transversely to the rolling direction. The first rolling surface 9 serves for closing the wide closure flap 7*c*, whereas the rolling surface 10 bends over the narrow closure flap 7*b* onto the wide closure flap 7*c* and presses such against the base portion 7*a*. At the end of the rolling surfaces 9, 10 there is attached at the rolling element 8 a cutter or knife 11 or equivalent structure, serving for cutting the band end which protrudes past the closure seal 7.

The rolling element 8 is seated upon a shaft 12 which, in a manner still to be described, is translatory displaceable in lengthwise direction of the closure seal 7, i.e., in the direction of the double-headed arrow A. Furthermore, seated upon this shaft 12 is a support roll or roller 13 which is arranged between two flanges 8*a* and 8*b* of the rolling element 8 and bears against the cover plate 4. At the other side of the intermediate wall 3 the shaft 12 further supports a toothed segment 14 having teeth 15. This method segment 14 is rigidly connected for rotation by means of a screw or threaded bolt 16 or equivalent structure with the following element 8. Rotation of the toothed segment 14 causes a corresponding rotation of the rolling element 8. The toothed segment 14 engages with its teeth 15 into a stationary gear rack or rack element 17 which is mounted at the base plate 1 and extends in the displacement direction A of the shaft 12. Rolling of the toothed segment 14 upon the rack 17 causes rotation of the rolling element 8.

In order to be able to displace the shaft 12 so as to have a translatory motion, and thus, to bring about a rolling of the toothed segment 14 upon the rack 17, there is provided a rack-and-pinion drive 18. The latter comprises a rack 19 which is displaceable in the direction of the double-headed arrow A and guided by two guides or guide elements 20, the bifurcated end of which has two flanges 19*a* and 19*b*. Between these flanges 19*a* and 19*b* there is arranged the toothed segment 14 and there is also mounted at these flanges 19*a* and 19*b* the shaft 12. Meshing with the rack 19 is a drive gear or pinion 21 which is attached to a shaft 22 mounted at the side wall 2 and the intermediate wall 3. At the end of this shaft 22 which protrudes past the side wall 2 there is secured an actuation lever 23 which has only been partially shown in the drawings. As best seen by referring to FIG. 2, this actuation lever 23 carries at its free end a spherical or ball-like handle 24. Actuation lever 23 is pivotable about the shaft 22 in the direction of the arrow B (FIG. 5), causing a translatory displacement of the rack 19 in the direction of the double-headed arrow A.

Furthermore, there is secured to the intermediate wall 3 a lever 25 which is pivotable about an axle or shaft 26. This lever 25 carries at its end which is located opposite the pivot shaft 26 a counter cutter or counter knife 27 which piercingly extends through the opening 3*a* at the intermediate wall 3. This counter cutter 27 coacts with the cutter 11 and serves for cutting the overlapping band portions or sections 28*a* and 28*b* of the band or strap 28 which is wrapped around a not particularly shown article. The upper band section or portion 28*b* leads to a not particularly illustrated band tensioning device by means of which it is possible to tension the band 28 as is conventional in equipment of this type. The lower band section 28*a* is fixedly retained in any suitable and therefore likewise not further shown manner. Both of the overlapping band sections 28*a* and 28*b* bear upon the base portion 7*a* of the closure or connection seal 7.

Having now had the benefit of the foregoing discussion of the exemplary embodiment of strapping equipment its mode of operation will now be considered and is as follows:

Following completion of tensioning of the band or strap 28 which has been previously inserted by means of its band sections or portions 28*a*, 28*b* in the still open closure seal 7 (FIG. 2) the latter is closed by the rolling element 8 which travels over such closure seal 7. Prior to the closing operation the rolling element 8 is located in its left-hand end or terminal position shown in FIG. 1, where it is out of engagement with the closure seal 7. Now if the actuation lever 23 is rocked in the direction of the arrow B out of its horizontal rest position then the rack 19 and together therewith the shaft 12 are moved translationally towards the right in the direction of the arrow A. During this translatory movement of the shaft 12 the toothed segment rolls upon the rack 17, which, as already described, causes rotation of the rolling element 8. Now the rolling element 8 presses, by means of its rolling surfaces 9 and 10, from one end of the closure seal 7 in the lengthwise direction thereof, progressively against the closure flaps or tabs 7*b* and 7*c*. As a result, the first rolling surface 9 initially presses the wide closure 7*c* against the upper band section 28*b*. Then by means of the second rolling surface 10 the narrow closure flap 7*b* is bent onto the wide closure flap 7*c* and pressed against the base portion 7*a*. FIGS. 5 and 6 show the progressive closing of the closure seal 7. Displacement of the closure seal 7 relative to the counter support 5 is prevented by appropriate stops provided in the recess 6. Now if the closure seal 7 is completely closed and the rolling element 8 arrives at the end of its rolling path of movement, then the cutter 11 cuts the band section 28*b* which protrudes past the closed closure seal 7. During the cutting operation this cutter 11 cooperates with the counter cutter 27. The rolling element 8 can be moved back again into its left-hand end position by return rocking or pivoting of the actuation lever 23, and the closure seal 7 is again completely pressed together during the return movement of the rolling element 8. This rearward movement of the rolling element 8 can also be accomplished by means of a compression or tension spring which, during the translatory forward movement of the shaft 12, is biased or tensioned.

With the described apparatus the closure flaps **7*b* and 7*c* of the closure seal 7 are progressively continuously placed over one another and pressed against the band sections 28*a*, 28*b* and the base portion 7*a* in the lengthwise direction of the closure seal 7 in the described manner. Since the closure flaps 7*b* and 7*c* do not have any tendency of again uprighting, there is obtained a sturdy connection of both band sections 28*a* and 28*b*** which can be placed under extreme tension load.

Instead of threadably interconnecting the rolling element 8 and the toothed segment 14, it is possible to also realize a rigid rotatable drive connection between the rolling element 8 and the toothed segment 14 in that both the rolling element 8 as well as also the toothed segment 14 are mounted rigidly for rotation upon the shaft 12. The rolling element 8 also can be formed of one-piece with the shaft 12. In the described manner it is also possible to close closure or connection seals whose closure flaps or tabs are not, as shown in FIG. 2, already pre-formed. Thus, for instance, it is possible to also close substantially U-shaped closure seals, whose closure flaps protrude approximately at right angles with respect to the base portion thereof. Under circumstances it can be necessary to tandomly arrange a number of the same or different rolling elements in the rolling direction, i.e., in the lengthwise direction of the closure seal.

It is also conceivable to arrange the rolling element upon a rotational shaft which does not move translatory in the rolling direction. In this case, the rolling surfaces of the rolling element must be correspondingly structured, so that during rotation of the rolling element the rolling surfaces progressively act, in the lengthwise direction of the closure seal, upon the closure flaps thereof.

Instead of using a rolling element which continuously progressively closes the closure flaps in the lengthwise direction of the closure seal, it is also possible to provide a number of punches or clamps or tongs or equivalent structure which are arranged, in the closing direction, behind one another, i.e., in the lengthwise direction of the closure seal, and to progressively actuate the same in succession in the lengthwise direction of the closure seal, in order to place over one another the closure flaps in sections and to press such against the base portion.

It is not only possible to interconnect, in the described manner, the overlapping sections of a band wrapped around an article or the like. Thus, for instance, it is also possible to connect the ends of two bands, stranded wires, cables and the like, by means of an appropriate closure seal. Furthermore, it is also possible, in the described manner, to apply a connection terminal to one end of an electrical cable, and the connection element which is attached at the cable end constitutes part of the connection terminal.

With other fields of application it is conceivable, under circumstances, to stationarily arrange the rolling or roller element which is rotatable about an axis of rotation and to move the counter support 5 together with the thereon bearing closure seal and carrier past the rotating rolling element.

While there are shown and described present preferred embodiments of the invention, it is to be distinctly understood that the invention is not limited thereto, but may be otherwise variously embodied and practiced within the scope of the following claims. Accordingly,

I claim:

1. A method for interconnecting the overlying sections of a band or strap, preferably a band or strap wound about an artcle, by means of a metallic closure element having closure flaps extending in the lengthwise direction thereof and located at opposite sides of a base portion of said closure element and protruding therefrom, comprising the steps of:

placing the overlying band or strap sections between the closure flaps, and progressively pressing against the base portion both closure flaps in the lengthwise direction of the closure element from one end of the closure element by rolling said closure flaps against the base portion, in order to thereby fixedly clamp the overlying band or strap sections between the base portion and the closure flaps.

2. The method as defined in claim 1, further including the step of:

progressively placing over one another the closure flaps simultaneously with the pressing of said closure flaps against the base portion.

3. The method as defined in claim 1, further including the step of:

flat rolling said closure flaps against the base portion.

4. An apparatus for interconnecting the overlying sections of a band or strap, preferably a band or strap wound about an article, by means of a metallic closure element having closure flaps protruding from a base portion thereof from opposite sides of said base portion, said closure flaps extending in the lengthwise direction of the closure element, comprising:

a closure device for progressively pressing against the base portion both closure flaps in the lengthwise direction of the closure element from one end of the closure element by rolling said closure flaps against the base portion.

5. The apparatus as defined in claim 4, wherein:

said closure device progressively places over one another the closure flaps simultaneously with the pressing of said closure flaps against the base portions.

6. The apparatus as defined in claim 4, wherein:

said closure device comprises at least one rolling element;

means for rolling said rolling element in a rolling direction coinciding with the lengthwise direction of the closure element;

said rolling element containing at least one rolling surface curved in the rolling direction and intended to progressively act upon the closure flaps.

7. The apparatus as defined in claim 6, wherein:

said means for rolling the rolling element comprises a shaft which is displaceable so as to carry out a translatory motion in the lengthwise direction of the closure element.

8. The apparatus as defined in claim 7, further including:

a rotatable rolling body rigidly connected for rotation with said rolling element about said shaft which is rotatable;

means defining a stationary rolling path; and said rolling body, during the lengthwise displacement of the rotational shaft, rolling upon said stationary rolling path.

9. The apparatus as defined in claim 8, wherein:

said rolling body is provided with teeth means;

said means defining a stationary rolling path comprising a toothed rack meshing with said teeth means; and said toothed rack extending in the displacement direction of the rotational shaft.

10. The apparatus as defined in claim 8, wherein:

said rolling element and said rolling body are arranged upon said shaft forming a common axis of rotation;

a translationally displaceable drive element with which there is operatively coupled said shaft.

11. The apparatus as defined in claim 10, wherein:

said drive element comprises a rack of a rack-and-pinion drive; and a pivotal actuation lever with which there is connected the driving pinion.

12. The apparatus as defined in claim 6, wherein:

said rolling surface of the rolling element comprises a substantially cylindrical jacket surface defining a first rolling surface.

13. The apparatus as defined in claim 12, wherein:

a second rolling surface merges with the first rolling surface which is intended to act upon the one closure flap;

said second rolling surface acting upon the other closure flap in the rolling direction and being curved transversely with respect to said rolling direction.

14. The apparatus as defined in claim 6, further including:

a second rolling surface merges with the first rolling surface which is intended to act upon the one closure flap;

said second rolling surface acting upon the other closure flap in the rolling direction and being curved transversely with respect to said rolling direction.

15. The apparatus as defined in claim 6, further including:

counter support means for receiving the closure element; and said counter support means extending in the lengthwise direction of the closure element and being situated opposite the closure device.

16. The apparatus as defined in claim 6, further including:

cutter means attached at the rolling element and arranged at the end of its rolling surface;

said cutter means serving to cut the section of the carrier protruding past the closure element.

17. The apparatus as defined in claim 7, further including:

cutter means attached at the rolling element and arranged at the end of its rolling surface;

said cutter means serving to cut the section of the carrier protruding past the closure element.

18. The apparatus as defined in claim 6, wherein:

said at least one rolling surface is smooth.

* * * * *